US006210246B1

(12) United States Patent
Perrin et al.

(10) Patent No.: US 6,210,246 B1
(45) Date of Patent: Apr. 3, 2001

(54) METHOD FOR MAKING AN ELECTRON SOURCE WITH MICROTIPS, WITH SELF-ALIGNED FOCUSING GRID

(75) Inventors: Aimé Perrin, St. Ismier; Brigitte Montmayeul, Bernin; Régis Blanc, St. Egreve, all of (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/463,383

(22) PCT Filed: May 25, 1999

(86) PCT No.: PCT/FR99/01218

§ 371 Date: Feb. 18, 2000

§ 102(e) Date: Feb. 18, 2000

(87) PCT Pub. No.: WO99/62093

PCT Pub. Date: Dec. 2, 1999

(30) Foreign Application Priority Data

May 26, 1998 (FR) ..... 98 06607

(51) Int. Cl.[7] ..... H01J 9/02
(52) U.S. Cl. ..... 445/24; 445/50
(58) Field of Search ..... 445/24, 50; 438/20

(56) References Cited

U.S. PATENT DOCUMENTS 5,136,764 * 8/1992 Vasquez ..... 29/25.01
5,559,389 * 9/1996 Spindt et al. ..... 313/310
5,981,304 * 11/1999 Rerrin et al. ..... 445/50
6,036,565 * 3/2000 Seko et al. ..... 445/50
6,045,426 * 4/2000 Wang et al. ..... 445/50

FOREIGN PATENT DOCUMENTS

2734401 * 11/1996 (FR) .
7-029484 * 1/1995 (JP) .

OTHER PUBLICATIONS

U.S. Patent application Ser. No. 09/529,425.*

* cited by examiner

*Primary Examiner*—Kenneth J. Ramsey
(74) *Attorney, Agent, or Firm*—Oblon, Spivak, McClelland, Maier & Neustadt, P.C.

(57) ABSTRACT

A process for manufacturing a micropoint electron source with an extraction grid and a focusing grid. This process allows for precise alignment of the holes of the extraction grid with the apertures of the focusing grid by using a single photolithography step for making the holes in the extraction grid. Such a process may find particular application for making a micropoint electron source for a flat viewing screen.

5 Claims, 5 Drawing Sheets

METHOD FOR MAKING AN ELECTRON SOURCE WITH MICROTIPS, WITH SELF-ALIGNED FOCUSING GRID

BACKGROUND OF THE INVENTION

1. Field of the Invention

This invention involves a process for manufacturing a micropoint electron source with an auto-aligned focussing grid. Such a micropoint electron source can be used in particular in a device for visualisation by cathodoluminescence excited by field emission.

2. Discussion of the Background

Documents FR-A-2 593 953 and FR-A-2 623 013 disclose devices for visualisation by cathodoluminescence excited by field emission. These devices include a emitting cathode electron source with micropoint.

By way of illustration, FIG. 1 is a cross section view of such a micropoint viewing screen. In the interest of simplification, only a few aligned micropoints are shown. The screen is composed of a cathode 1, which is a plane structure, oriented with respect to another plane structure which forms the anode 2. The cathode 1 and the anode 2 are separated by a space in which a vacuum has been created. The cathode 1 includes a glass substrate 11 on which the conducting level 12 has been applied in contact with the electron emitting points 13. The conducting level 12 is covered with a layer of insulation 14, made of silica for example, which is itself covered by a conducting layer 15. Holes 18 of about 1.3 •m in diameter were made through the layers 14 and 15 up to the conducting level 12 to apply the points 13 on this conducting level. The conducting layer 15 acts as an extraction grid for the electrons which will be emitted by the points 13. The anode 2 includes a transparent substrate 21 covered by a transparent electrode 22 on which luminescent phosphors or luminophores 23 have been deposited.

The operation of this screen will now be described. The anode 2 is brought to a positive voltage of several hundred volts with respect to the points 13 (typically 200 to 500 V). A positive voltage of several dozens of volts (typically 60 to 100 V) with respect to the points 13 is applied to the extraction grid 15. Electrons are then drawn from the points 13 and are attracted by the anode 2. The trajectories of the electrons are within a half-angle cone at the peak •, depending on various factors such as the shape of the points 13. This angle causes a defocusing of the electron beam 31 which increases as the distance between the anode and the cathode is increased. One way to increase the yield of the phosphors, and thus the luminosity of the screens, is to work with higher anode-cathode voltages (between 1,000 and 10,000 V), which implies separating the anode and the cathode further in order to avoid the formation of an electric arc between these two electrodes.

If good resolution on the anode is desired, the electron beam must be refocused. This refocusing is classically obtained with a grid which can either be placed between the anode and the cathode or placed on the cathode.

FIG. 2 illustrates the case where the focussing grid is placed on the cathode. FIG. 2 repeats the example of FIG. 1, but limited to a single micropoint for greater clarity in the drawing. An insulating layer 16 was applied to the extraction grid 15 and bears a metallic layer 17 which acts as a focussing grid. Holes 19 of an appropriate diameter (typically between 8 and 10 •m) and concentric to holes 18, were etched in layers 16 and 17. The insulating layer 16 electrically insulates the extraction grid 15 and the focussing grid 17. The focussing grid is polarised with respect to the cathode in order to give the electron beam the shape shown in FIG. 2.

Simulation calculations show that centering of the holes 19 of the focussing grid with respect to the holes 18 of the extraction grid is extremely important. This structure is generally made using the classic photoetching techniques used in microelectronics. For example, with a first level of photoetching, the holes 19 of the focussing grid are defined, then a second level of photoetching is used to make holes 18 in which the points will be placed. To ensure proper functioning, the second level must be positioned in an extremely precise manner with respect to the first level. This can only be done with very high-quality, expensive equipment, a serious drawback if large areas are treated. In addition, if the holes of the extraction grid are made by photolithography from a microsphere network, their arrangement is random, which rules out the use of a phototemplate for making the apertures of the focussing grid.

SUMMARY OF THE INVENTION

The invention solves the problem of precision alignment of holes located on different levels. This is achieved by a process which requires only a single photolithography step which makes the holes in the extraction grid.

The purpose of the invention is thus the making of a micropoint electron source with an extraction grid and a focussing grid involving:

- the successive depositing on one side of an electrically insulating support of means of cathodic connection, a first insulating layer of thickness adapted to the height of the future micropoints, a first conducting layer to form the extraction grid, a second insulating layer of thickness corresponding to the distance which must separate the extraction grid from the focusing grid, a second conducting layer to form the focusing grid and a photosensitive resin layer;
- the etching, by photolithography, of the photosensitive resin layer to make holes in it which exit on the second conducting layer and of which the axes correspond to the axes of the future micropoints and of which the diameter is adapted to the size of the future micropoints, these holes permitting etching of the other layers deposited on the support;
- the etching of the second conducting layer to make holes in it which exit at the second insulating layer;
- the etching of the second insulating layer to make cavities in it which are to be extended laterally up to a dimension corresponding to the apertures of the focussing grid and which reveal the first conducting layer;
- etching of the first conducting layer to make holes in it for the extraction grid;
- etching of holes in the first insulating layer until they reach the means of cathodic connection in order to make housings for the micropoints;
- enlargement by etching of the holes of the second conducting layer to obtain apertures for the focusing grid;
- elimination of the photosensitive resin layer remaining after the etching operations;
- formation of micropoints in their housings on the means of cathodic connection.

The means of cathodic connection are preferably made by depositing cathodic conductors on the support, followed by depositing of a resistant layer.

A first way of etching the second insulating layer would be as follows:

the second insulating layer is first etched to obtain the holes in the prolongation of the holes of the photosensitive resin layer which come out on the first conducting layer;

the first conducting layer is then etched tof obtain the blind holes in the prolongation of the holes of the photosensitive resin layer, these blind holes constituting the beginnings of the holes of the extraction grid;

lastly, the second insulating layer is etched until the aforesaid cavities are obtained.

The etching of the holes in the first insulating layer can first be done anisotropically, the aforesaid housings then being defined by isotropic etching.

A second way of etching the second insulating layer is as follows. Since the first and second insulating layers can be etched simultaneously, the etching of the second insulating layer is first done isotropically to mark the places for the cavities, to reach the first conducting layer, revealing the zones allowing for making holes for the extraction grid, the holes of the extraction grid then being etched in the first conducting layer, an isotropic etching being lastly done to simultaneously obtain the aforesaid housings in the first insulating layer and the aforesaid cavities of the aforesaid dimension in the second insulating layer.

BRIEF DESCRIPTION OF THE DRAWING

The invention will be better understood and its other advantages and characteristics will be clearer with a reading of the following description, which is given as a non-limiting example, accompanied by drawing in appendix among which.

DESCRIPTION OF THE PREFERRED EMBODIMENTS

Figure 1:
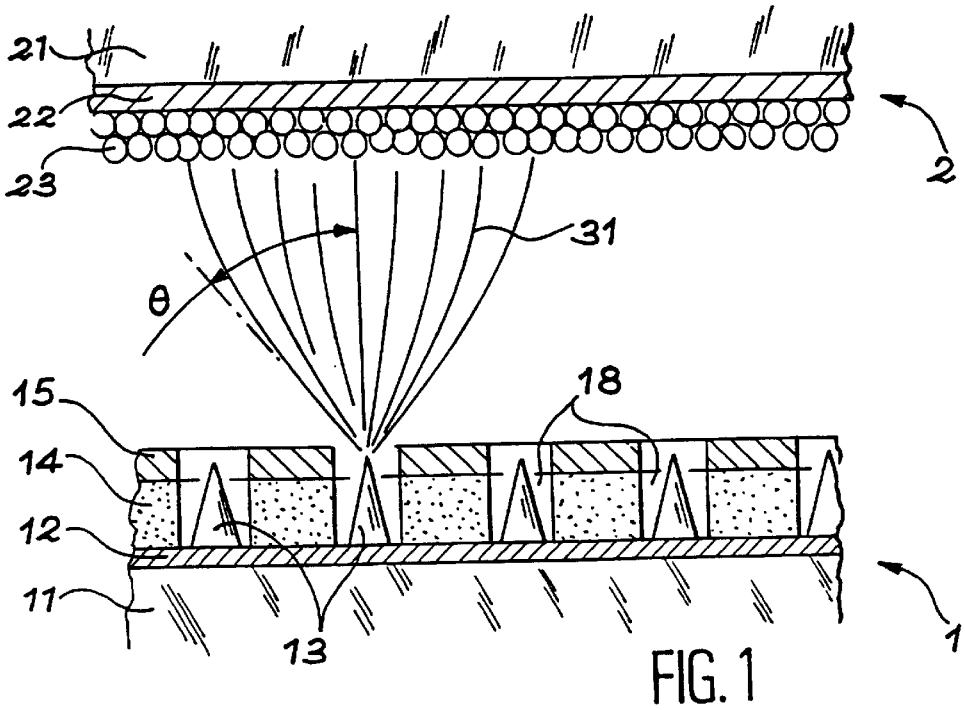
FIG. 1, already described, illustrates a flat micropoint screen based on the prior art.
Figure 2:
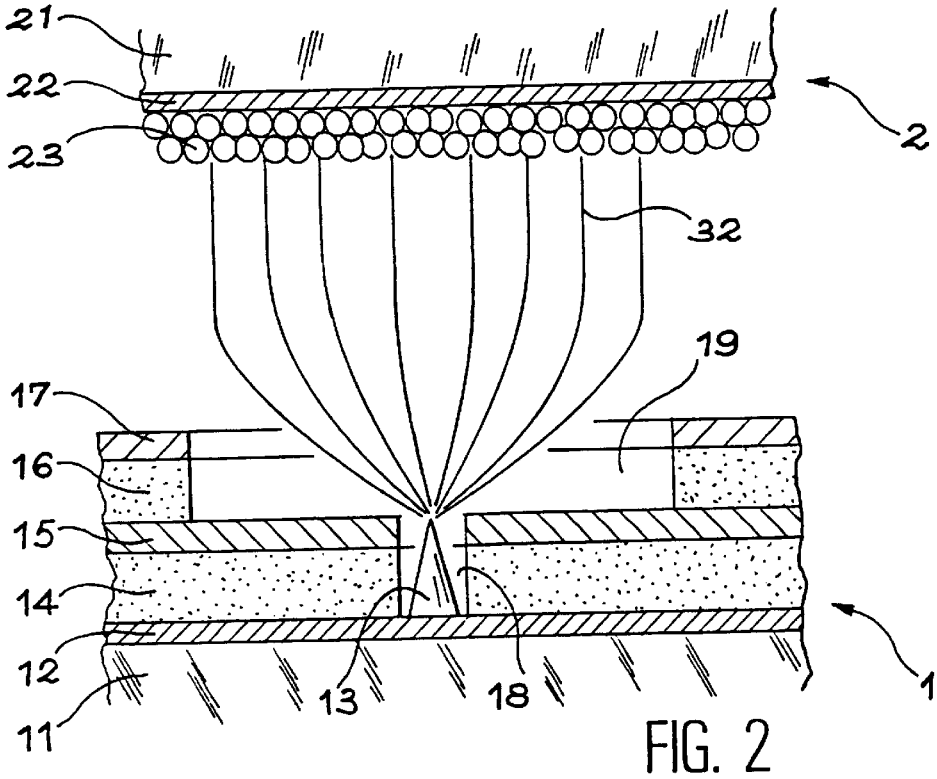
FIG. 2, already described, illustrates a flat micropoint screen with a focussing grid based on the prior art.

FIGS. 3A to 3F are cross-section views of a micropoint electron source being manufactured according to a first mode for applying the process according to the invention.

On a support 50 composed of a glass chip, a metallic layer is deposited (see FIG. 3A) which is etched to make cathodic conductors 51 which are parallel to each other. These cathodic conductors 51 can be used as columns for matrix display for example. A resistant layer 52 is then deposited in a uniform manner. On this resistant layer 52 are successively deposited a first insulating layer 53, a first conducting layer 54 to form the extraction grid for the micropoint electron source, a second insulating layer 55 and a second conducting layer 56 to form the focussing grid. The thicknesses of the insulating layers 53 and 55 are chosen as a function of the chosen height of the micropoints and the distance which must separate the extraction grid from the focussing grid. A layer of photosensitive resin 57 is then deposited in a uniform manner on the second conducting layer 55.

Figure 3A:
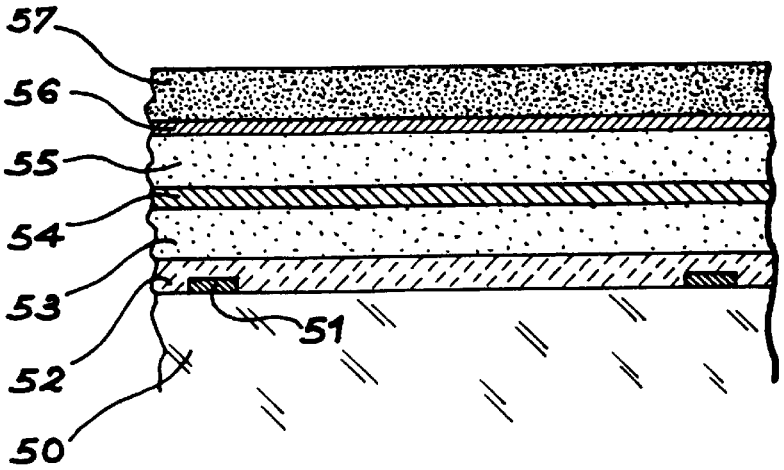
FIGS. 3A to 3F illustrate the manufacturing of a micropoint electron source according to the first way of using the process of this invention.
Figure 3B:
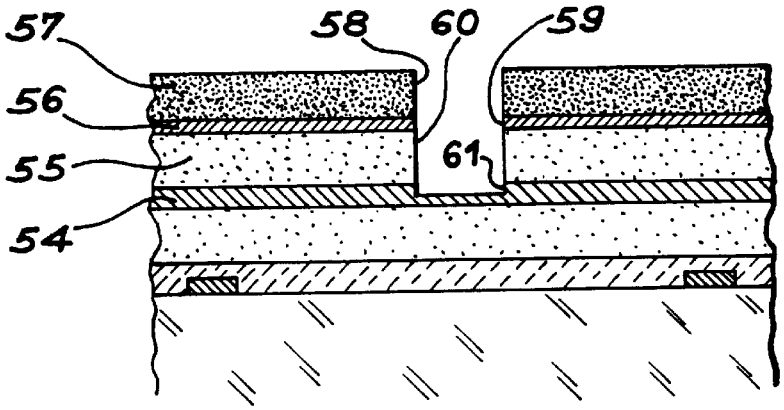

The photosensitive resin layer 57 is insolated through a template and then developed to make axis holes 58 corresponding to the axes of the micropoints to be made (see FIG. 3B in which a single hole 58 is shown). These holes allow for etching of the underlying layers. The holes 58 are prolonged by holes 59 etched in the second conducting layer 56, which are prolonged by holes 60 etched in the second insulating layer 55.

These rows of holes 58, 59 and 60 are then prolonged by holes 61 etched in the thickness of the first conducting layer 54. At this stage, the holes 61 do not go through the first conducting layer 54.

Figure 3C:
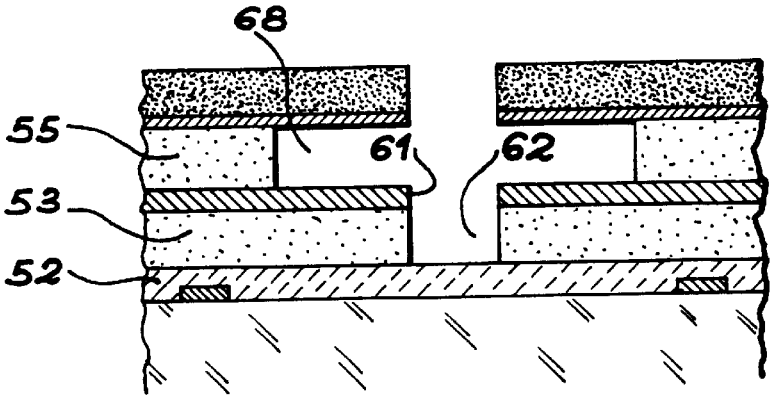
Figure 3D:
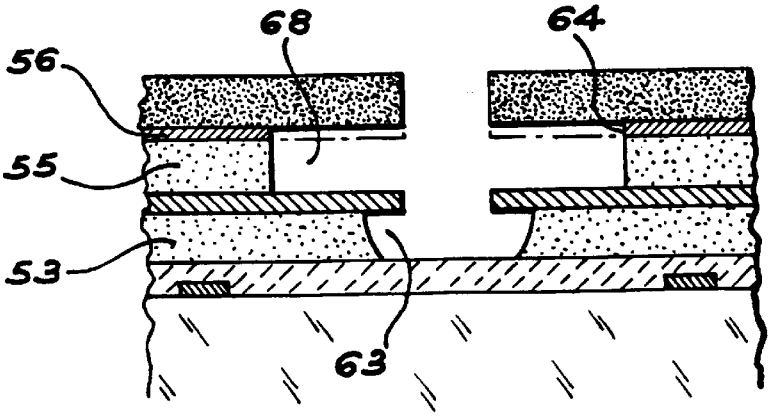

Still by etching, the holes 60 in the second insulating layer 55 are enlarged to a determined diameter corresponding to the diameter of the apertures to be made in the focussing grid. This gives cavities 68 as shown in FIG. 3C.

Holes 61 are then etched in the first conducting layer 54 in order to reveal the first insulating layer 53. The holes 61 are then prolonged, by etching, by holes 62 made in the first insulating layer 53 until it reaches the resistant layer 52 which is thus revealed.

In order to provide appropriate housings for the micropoints, the holes 62 made in the first insulating layer 53 are enlarged by isotropic etching. This gives the housings 63 shown in FIG. 3D. The second conducting layer 56 is then etched so as to enlarge the holes of this layer to the dimension of the cavities 68 of the second insulating layer 55. This gives the apertures 64 of the focussing grid.

Figure 3E:
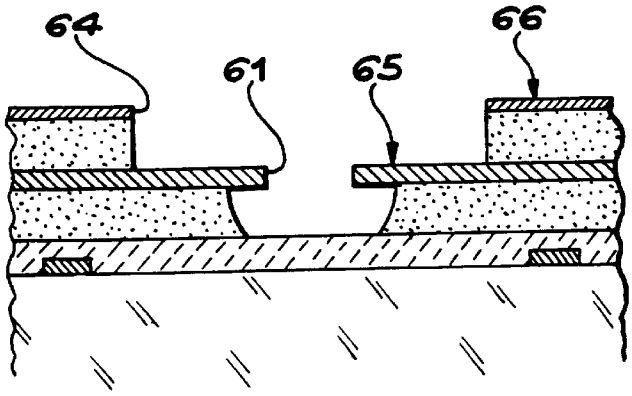
Figure 3F:
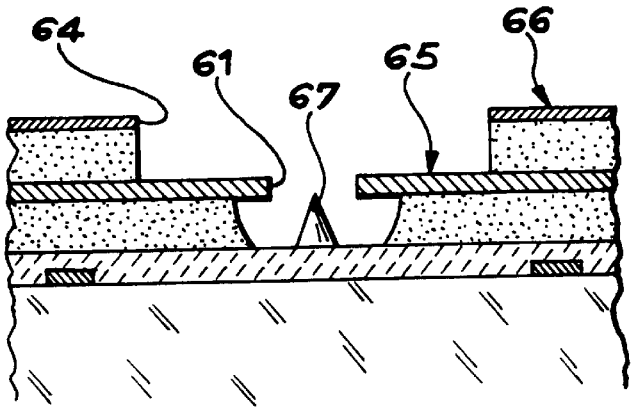

The photosensitive resin is eliminated, giving the structure shown in FIG. 3E. The extraction grid 65 and the focussing grid 66 are thus definitively formed. Because of the process according to the present invention, each aperture 54 of the focussing grid 66 is perfectly aligned with the corresponding hole 61 of the extraction grid 65.

The last step of the process involves making micropoints by a method known to people in the field. Each micropoint 67 is thus perfectly aligned along the axis of the corresponding hole 61 of the extraction grid 65 and along the axis of the corresponding aperture of the focussing grid 66.

FIGS. 4A to 4D are cross-section views of a micropoint electron source being manufactured according to a second mode for applying the process according to the invention. This mode can be used when the two insulating layers are of the same type or are not etched in a chemically selective manner.

On FIGS. 4A to 4D, the same references as those on FIGS. 3A to 3F indicate the same elements, only the nature of the materials may change.

Figure 4A:
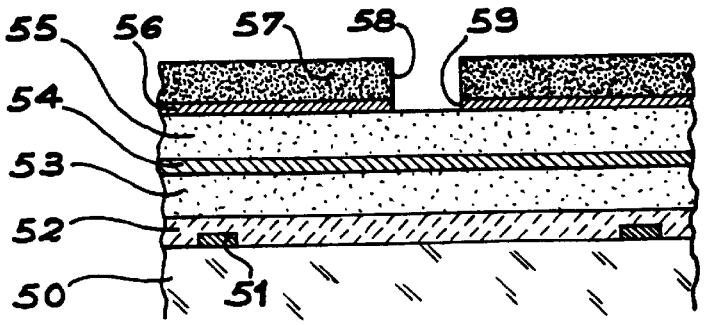
FIGS. 4A to 4D illustrate the manufacturing of a micropoint electron source according to the second way of using the process of this invention.
Figure 4B:
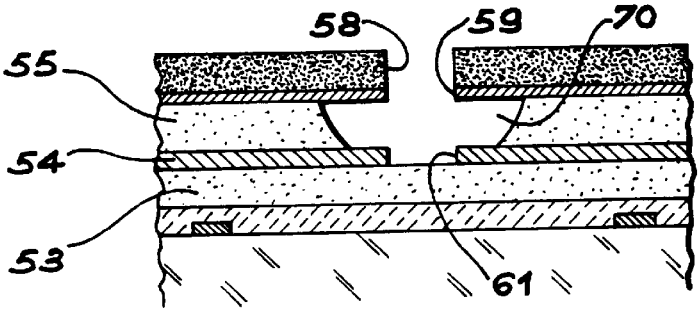

As previously, the photosensitive resin layer 57 is insolated through a template and then developed to make holes 58 in it and these holes 58 are prolonged by holes 59 etched in the second conducting layer 56 (see FIG. 4B).

Then anisotropic etching of the first conducting layer 54 is done to make holes 61 in it in the prolongation of the holes 58 and 59. These holes 61 are holes in the extraction grid. They reveal the first insulating layer 53.

Figure 4C:
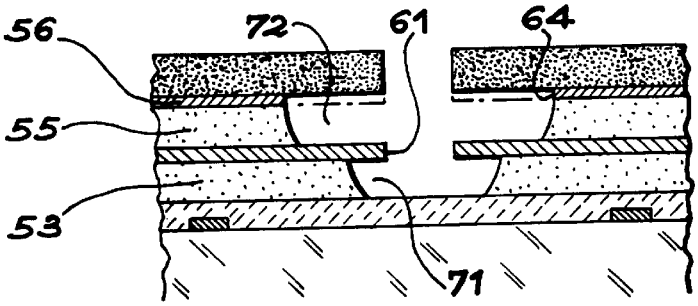
Figure 4D:
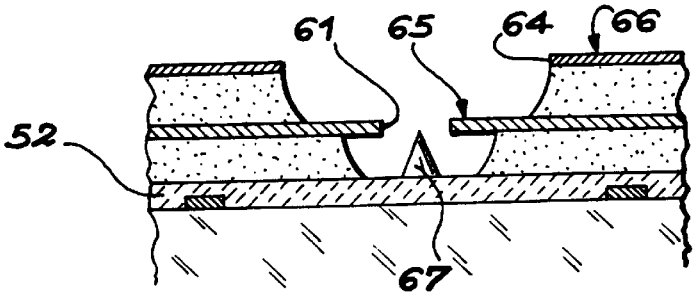

The first insulating layer 53 is then isotropically etched to make, in this layer, the housings 71 centred on the axis of the holes 61 (see FIG. 4C). The two insulating layers 53 and 55 being of the same nature, this etching leads to enlargement of the cavities already made in the second insulating layer 55 to yield cavities 72. The two etching steps for the second insulating layer 65 are designed to produce cavities 72 whose maximum dimensions correspond to the apertures of the focussing grid.

The second conducting layer 56 is then etched so as to enlarge the holes of this layer to the maximum dimensions of the cavities 72 of the second insulating layer 55. The apertures 64 of the focussing grid are thus obtained.

The photosensitive resin is then eliminated (see FIG. 4D) and the micropoints 67 can be deposited on the resistant layer 52. Each micropoint 67 is thus perfectly aligned along the axis of the corresponding hole 61 of the extraction grid 65 and the axis of the corresponding aperture 64 of the focussing grid 66.

Depending on the nature of the materials used to make the various layers and the desired degree of precision, many variants in the invention process are possible by grouping certain steps or changing their order.

Figure 5:
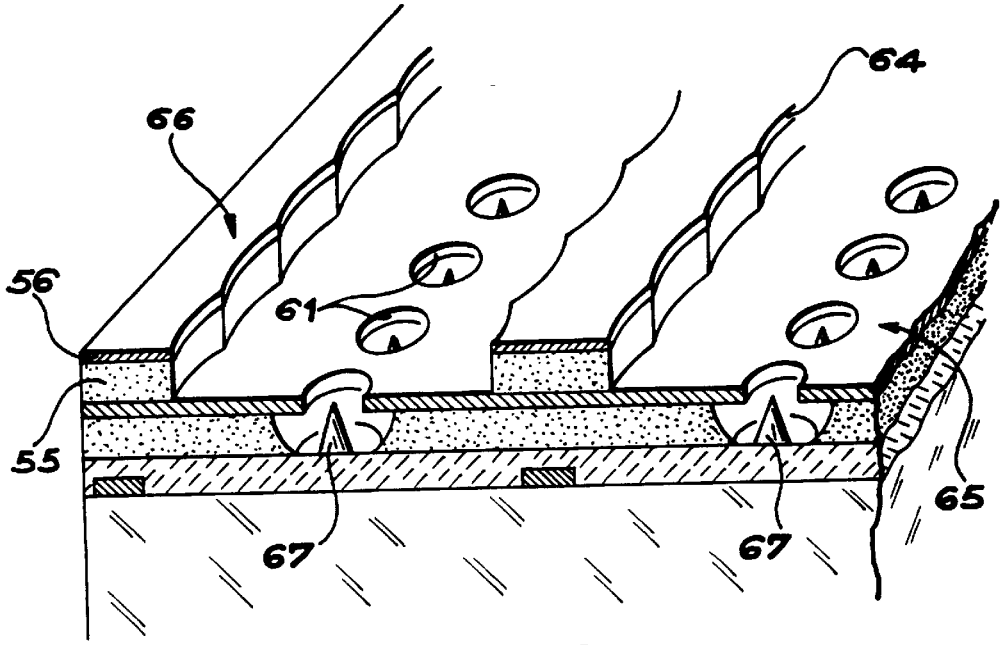
FIG. 5 is a partial and perspective view of a micropoint electron source made by the process of the present invention and in which the micropoints are arranged in lines, the distance between the adjacent micropoints of a given line being less than the diameter of the holes of the focussing grid.

Various geometries for the focussing grid are possible. FIG. 5 shows an example of a micropoint electron source obtained with the first mode of applying the invention process. In this example the holes 61 of the extraction grid 65 and the micropoints 67 are arranged along parallel lines. The distance separating two successive holes 61 on a given line is less then the aperture 64 of the focussing grid 66. The distance between two lines of adjacent micropoints is greater than this aperture. The enlargement of the holes in the layers 55 and 56 to the diameter desired for the focussing grid 66 produces intersecting holes. The apertures of the focussing grid corresponding to a given line of micropoints 67 thus constitute slits with festooned sides, the axes of these slits being the same as the lines on which the corresponding micropoints are arranged. For such a structure, the focussing of the electrons is done only in the direction perpendicular to the planes of symmetry of the slits. The luminophores placed on the anode which, in the viewing device, faces the cathode, must be arranged along lines parallel to the emitting lines.

Figure 6:
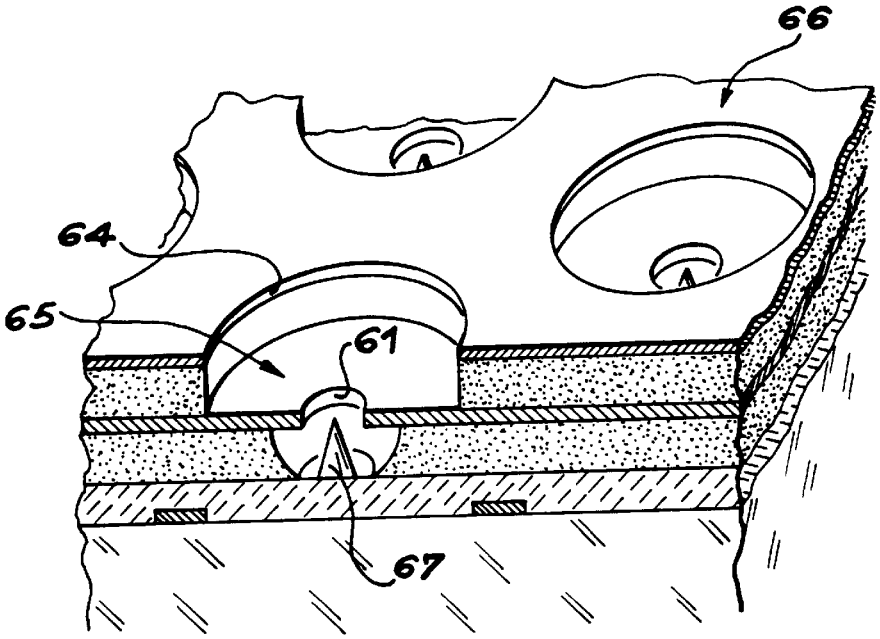
FIG. 6 is a partial and perspective view of a micropoint electron source made by the process of the present invention, the distance between two adjacent micropoints being greater than the diameter of the holes of the focussing grid.

FIG. 6 shows another example of micropoint electron sources obtained by the first mode of applying the present invention. In this example, the holes 61 of the extraction grid 65 are located with respect to each other at a distance greater then the diameter of the apertures 64 of the focussing grid 66. In this case, the openings 64 of the focussing grid 66 are holes concentric to the holes 61 of the extraction grid 65. The electrons emitted by the micropoints 67 are then focussed regardless of their emission direction.

What is claimed is:

1. Process for manufacturing a micropoint electron source with an extraction grid and a focusing grid comprising the steps of:

successive depositing on one side of an electrically insulating support of means of cathodic connection, a first insulating layer of thickness adapted to the height of the future micropoints, a first conducting layer to form the extraction grid, a second insulating layer of thickness corresponding to the distance which must separate the extraction grid from the focusing grid, a second conducting layer to form the focusing grid and a photosensitive resin layer;

etching, by photolithography, of the photosensitive resin layer to make holes in it which exit on the second conducting layer and of which the axes correspond to the axes of the future micropoints and of which the diameter is adapted to the size of the future micropoints, these holes permitting etching of the other layers deposited on the support;

etching of the second conducting layer to make holes in it which exit at the second insulating layer;

etching of the second insulating layer to make cavities in it which are to be extended laterally up to a dimension corresponding to the apertures of the focusing grid and which reveal the first conducting layer;

etching of the first conducting layer to make holes in it for the extraction grid;

etching of holes in the first insulating layer until they reach the means of cathodic connection in order to make housings for the micropoints;

enlargement by etching of the holes of the second conducting layer to obtain apertures for the focusing grid;

elimination of the photosensitive resin layer remaining after the etching operations;

formation of micropoints in their housings on the means of cathodic connection.

2. Process according to claim 1, in which the means of cathodic connection are obtained by depositing of cathodic conductors on the support, followed by depositing of a resistant layer.

3. Process according to claim 1, in which the etching of the second insulating layer comprises the steps of:

etching the second insulating layer to obtain the holes in the prolongation of the holes of the photosensitive resin layer which come out on the first conducting layer;

etching the first conducting layer to obtain the blind holes in the prolongation of the holes of the photosensitive resin layer, the blind holes constituting the beginnings of the holes of the extraction grid;

etching the second insulating layer until the aforesaid cavities are obtained.

4. Process according to claim 1, in which the etching of the holes in the first insulating layer is first done anisotropically, the aforesaid housings then being defined by isotropic etching.

5. Process according to claim 1, in which the first and second insulating layers, being apt to be etched simultaneously, the etching of the second insulating layer is first done isotropically to mark the places for the cavities, to reach the first conducting layer, revealing the zones allowing for making holes for the extraction grid, the holes of the extraction grid then being etched in the first conducting layer, an isotropic etching being lastly done to simultaneously obtain the aforesaid housings in the first insulating layer and the aforesaid cavities of the aforesaid dimension in the second insulating layer.

* * * * *

UNITED STATES PATENT AND TRADEMARK OFFICE

CERTIFICATE OF CORRECTION

PATENT NO. : 6,210,246 B1
DATED : April 3, 2001
INVENTOR(S) : Perrin et al.

It is certified that error appears in the above-identified patent and that said Letters Patent is hereby corrected as shown below:

Title page,
Item [86], should read as follows:

-- [86] PCT No.: PCT/FR99/01218
§ 371 Date: Feb. 17, 2000
§ 102(e) Date: Feb. 17, 2000

Signed and Sealed this

Twentieth Day of November, 2001

*Attest:*

Nicholas P. Godici

*Attesting Officer*

NICHOLAS P. GODICI
*Acting Director of the United States Patent and Trademark Office*